US010118434B2

(12) United States Patent
Thorsbakken et al.

(10) Patent No.: US 10,118,434 B2
(45) Date of Patent: Nov. 6, 2018

(54) CADDY VALET WITH SPACED ADHESIVE

(71) Applicants: Arden L. Thorsbakken, Eau Claire, WI (US); Maxwell James Thorsbakken, Eau Claire, WI (US)

(72) Inventors: Arden L. Thorsbakken, Eau Claire, WI (US); Maxwell James Thorsbakken, Eau Claire, WI (US)

( * ) Notice: Subject to any disclaimer, the term of this patent is extended or adjusted under 35 U.S.C. 154(b) by 0 days.

(21) Appl. No.: 15/706,161

(22) Filed: Sep. 15, 2017

(65) Prior Publication Data

US 2018/0079253 A1 Mar. 22, 2018

Related U.S. Application Data

(60) Provisional application No. 62/495,471, filed on Sep. 16, 2016.

(51) Int. Cl.

| | |
|---|---|
| ***A47F 5/08*** | (2006.01) |
| ***A47F 5/10*** | (2006.01) |
| ***B42D 5/00*** | (2006.01) |
| ***B43K 23/00*** | (2006.01) |
| ***B43K 23/06*** | (2006.01) |

(52) U.S. Cl.

CPC ..... *B43K 23/002* (2013.01); *A47F 5/08* (2013.01); *A47F 5/10* (2013.01); *B42D 5/006* (2013.01); *B43K 23/06* (2013.01)

(58) Field of Classification Search

CPC ..... B43K 23/002; B43K 23/06; B43K 23/00; B43K 23/001; B43K 25/00; B43K 25/026; B43K 29/00; B43K 29/20; B43M 99/00; B42D 5/006; A47F 7/0021; A47F 5/08; A47F 5/10

USPC ..... 211/2, 72, 87.01, 88.01, 96, 99, 90.02, 211/69.1; 248/683, 682, 693, 687, 447.1, 248/201, 205.2, 205.3, 213.2, 309.1, 310; 40/630, 661.06, 661.07, 661.09; 401/131, 401/195; 281/30

See application file for complete search history.

(56) References Cited

U.S. PATENT DOCUMENTS

| | | | | | |
|---|---|---|---|---|---|
| 348,124 | A * | 8/1886 | Hood | A47B 13/00 | 312/232 |
| 794,099 | A * | 7/1905 | Heaney | A47B 21/045 | 248/442.2 |
| 1,544,016 | A * | 6/1925 | Lyman | B43K 23/001 | 211/1 |
| 1,817,396 | A * | 8/1931 | Panchot | G09F 3/18 | 248/447.1 |
| 1,832,318 | A * | 11/1931 | Myers | G09F 3/06 | 40/334 |

(Continued)

*Primary Examiner* — Jennifer E. Novosad

(74) *Attorney, Agent, or Firm* — Skinner and Associates; Joel Skinner

(57) ABSTRACT

A holder for holding at least two utensils to an external surface. The holder includes a base having front and back faces, and a top, bottom and two side edges; a connector coupled to the back face of the base and adapted to be connected to the external surface; and a ledge having top and bottom faces and top, bottom and two side edges. The ledge back face is adhered to the front face of the base. The ledge is pivotal with respect to the base so that the top and bottom faces are substantially perpendicular to the base. The top, bottom or both ledge faces are adapted to connect to a utensil. A method of using the holder to hold a writing instrument and pad of note papers is also disclosed.

19 Claims, 7 Drawing Sheets

(56) References Cited

U.S. PATENT DOCUMENTS 2,149,978 A * 3/1939 Noel ..... G09F 7/00 211/50
2,192,607 A * 3/1940 Anderson ..... B42D 5/001 281/30
2,549,200 A * 4/1951 Hooks ..... B42F 9/00 211/69.1
2,591,351 A * 4/1952 Gray ..... B42D 5/001 281/44
2,604,724 A * 7/1952 Watts ..... H04M 1/21 211/69.1
2,755,576 A * 7/1956 Golden ..... G09F 1/10 2/279
3,169,341 A * 2/1965 White ..... B42D 5/006 281/44
3,314,634 A * 4/1967 Carter ..... H01F 7/0252 211/39
3,410,513 A * 11/1968 Wolf ..... B42D 5/005 211/48
3,430,300 A * 3/1969 Doan ..... A61M 25/02 128/DIG. 26
3,466,774 A * 9/1969 Borresen ..... G09F 3/18 206/232
3,799,487 A * 3/1974 Durrant ..... A47B 29/00 248/125.1
4,143,847 A * 3/1979 Cross ..... A47B 19/08 248/459
D262,027 S * 11/1981 Francis ..... D14/254
4,310,137 A * 1/1982 Frye ..... F16B 47/003 248/205.3
4,318,471 A * 3/1982 Hutton ..... A47B 97/08 206/214
4,395,056 A * 7/1983 Sferragatta ..... B42D 5/007 206/45.21
4,466,659 A * 8/1984 Carpentier ..... A47C 7/70 108/149
4,699,303 A * 10/1987 Kline ..... A63B 55/408 224/667
4,762,258 A * 8/1988 Murphy ..... B60R 7/08 108/44
4,832,207 A * 5/1989 Alexander ..... A47F 5/0068 206/449
5,098,128 A * 3/1992 Husta ..... H04M 1/21 281/45
5,150,284 A * 9/1992 Dobert ..... B60Q 1/30 248/205.2
5,263,593 A * 11/1993 Aida ..... B43M 99/002 211/69.1
5,328,137 A * 7/1994 Miller ..... B65D 73/0028 248/205.3
5,332,093 A * 7/1994 Littlepage ..... A45C 7/0095 190/102
5,337,906 A * 8/1994 Digiulio ..... B43M 99/006 211/69.1
5,377,794 A * 1/1995 Book ..... A45C 9/00 190/1
5,480,058 A * 1/1996 Hutchins ..... A47B 5/04 206/549
5,664,673 A * 9/1997 Perry ..... B43K 23/001 206/371
5,707,032 A * 1/1998 Ehrlich ..... A47G 11/006 160/368.1
5,788,080 A * 8/1998 Sill ..... B65D 33/2508 206/554
5,996,778 A * 12/1999 Shih ..... A45C 11/34 206/214
6,398,178 B1 * 6/2002 Azola ..... A47B 21/045 248/442.2
6,447,863 B1 * 9/2002 Lewin ..... G09F 3/02 40/359
6,641,105 B1 * 11/2003 Hamerski ..... A47G 1/20 248/205.3
6,682,798 B1 * 1/2004 Kiraly ..... B42D 15/006 281/5
7,178,770 B2 * 2/2007 Ryu ..... A47G 1/175 248/205.3
7,276,272 B2 * 10/2007 Mizuno ..... A47G 1/175 428/40.1
7,325,340 B2 * 2/2008 Chen ..... B42D 5/043 40/120
7,789,430 B2 * 9/2010 Wittmeyer, Jr. ..... B43K 23/002 248/441.1
2003/0168571 A1 * 9/2003 Malejko ..... A47B 23/04 248/447.1
2009/0114611 A1 * 5/2009 Munyan ..... A47B 46/005 211/90.02
2009/0278344 A1 * 11/2009 Hadden-Wight ..... B42D 3/12 281/30
2013/0157246 A1 * 6/2013 Shapiro ..... B43L 1/00 434/408
2013/0214577 A1 * 8/2013 Mojtabavi ..... A47B 3/08 297/331
2014/0151525 A1 * 6/2014 Cheng ..... A45D 42/10 248/467
2014/0306076 A1 * 10/2014 Friesch ..... A47G 1/17 248/205.3
2018/0079253 A1 * 3/2018 Thorsbakken ..... B43K 23/002

* cited by examiner

CADDY VALET WITH SPACED ADHESIVE

CROSS-REFERENCE TO RELATED APPLICATIONS, IF ANY

This application claims the benefit under 35 U.S.C. § 119(e) of U.S. Provisional Patent Application Ser. No. 62/495,471 filed Sep. 16, 2016, which is hereby incorporated by reference.

37 C.F.R. § 1.71(e) AUTHORIZATION

A portion of the disclosure of this patent document contains material which is subject to copyright protection. The copyright owner has no objection to the facsimile reproduction by anyone of the patent document or the patent disclosure, as it appears in the US Patent and Trademark Office patent file or records, but otherwise reserves all copyright rights whatsoever.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND

1. Field

The present invention relates, generally, to household, office and other accessories. More particularly, the invention relates to household, office and other article holders. Most particularly, the invention relates to a holder for holding a writing instrument and a pad of note papers to a wall or other convenient surface or location.

2. Background Information

Use of paper slips with releasable adhesive on one or more segments is common and handy for professional people in all areas of commerce. The user normally has a pad located somewhere near the work area for efficiency, however, in many instances, the pad has somehow been misplaced and or moved and the user spends valuable time looking or 'feeling' for it. There are on the market several types of sticky pad dispensers however, they too are frequently misplaced or in many times they simply do not work and expensive thus there is a need for an efficient and quick and economical method or appliance or device for locating sticky notes in handy mid remembered places. There is here in this invention; a better way.

Existing technology, is believed to have significant limitations and shortcomings.

For these and other reasons, a need exists for the present invention.

All US patents and patent applications, and all other published documents mentioned anywhere in this application are hereby incorporated by reference in their entirety.

BRIEF SUMMARY

The present invention provides a note taking system, apparatus and method which are practical, reliable, easy to deploy and use, and efficient, and which are believed to fulfill a need and to constitute an improvement over the background technology.

In one aspect, the invention provides a holder for holding at least two utensils to an external surface, including, a base having front and back faces, and a top, bottom and two side edges;

a connector coupled to the back face of the base and adapted to be connected to the external surface; and a ledge having top and bottom faces and top, bottom, and two side edges, the ledge back face being adhered to the from face of the base; the ledge being pivotal with respect to the base so that the top and bottom faces are substantially perpendicular to the base, and wherein the top, bottom or both ledge faces are adapted to connect to a utensil.

In another aspect, the invention provides a method of holding at least two utensils to an external surface, including the steps of:

a. providing a holder including:

i. a base having front and back faces, and a top, bottom and two side edges;

ii. a connector coupled to the back face of the base and adapted to be connected to the external surface; and iii. a ledge having top and bottom faces and top, bottom and two side edges, the ledge back face being adhered to the front face of the base; the ledge being pivotal with respect to the base so that the top and bottom faces are substantially perpendicular to the base, and wherein the top, bottom or both ledge faces are adapted to connect to a utensil;

b. pivoting the ledge with respect to the base;

c. placing one utensil on an upwardly facing ledge face; and d. adhesively coupling a second utensil to the downwardly facing ledge face.

The aspects, features, advantages, benefits and objects of the invention will become clear to those skilled in the art by reference to the following description, claims and drawings.

BRIEF DESCRIPTION OF THE SEVERAL VIEWS OF THE DRAWING

The present invention, and the manner and process of making and using it, will be better understood by those skilled in the art by reference to the following drawings.

FIG. 10 is a crossectional view of the deployed device taken along line 10-10 of FIG. 8, and attached to an exterior surface such as a vertical wall, furniture surface of the like.

DETAILED DESCRIPTION

The invention provides a handy and easy to use device for initial adhesion to surfaces such as walls, counters, desks, workstations, PCs, telephones, and the like. It is economical; easy to use and extremely versatile in that it has a tab for uncovering adhesive that extends ail of the way around and is removable by simply pulling down on the handle in a smooth release manner and which leaves no residue as would a glue. An ordinary glue tape can be used however with the inherent shortcomings. In practice, the device is utilized with a commercial pad of releasable notes with the releasable surface facing out at the top area near the handle insertion area. This secures the entire pad to the device, which is then positioned at a convenient positon on the work or other desired areas.

The invention is significant as a mechanical discovery as it reveals the surprising fact that the marriage of two overlapping releasable components of sticky notes is of surprising strength and as utilized in this patent as the union is capable of supporting a packet of 100 sticky notes in a pad and in addition the last note utilized leaves a sticky note still attached to the device with releasable adhesive segment, facing outward, which can join with another sticky pad without replacement of the device or other adhesive utilized.

Figure 1:
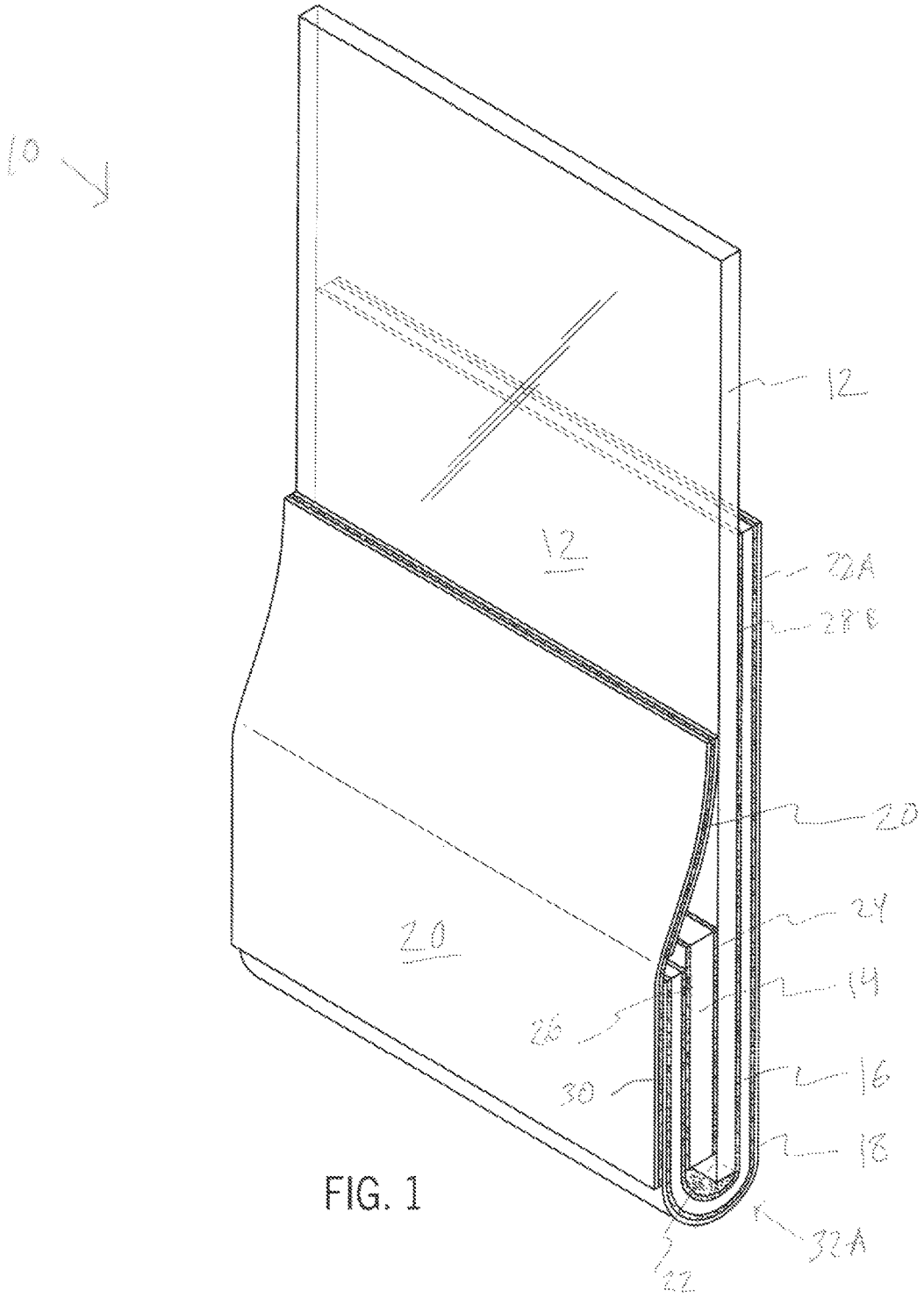
FIG. 1 is perspective or isometric view of an embodiment of the device of the invention in a normal un-deployed state. This is the state that a user would encounter upon receiving the device from some (optional) form of outer commercial packaging.
Figure 4:
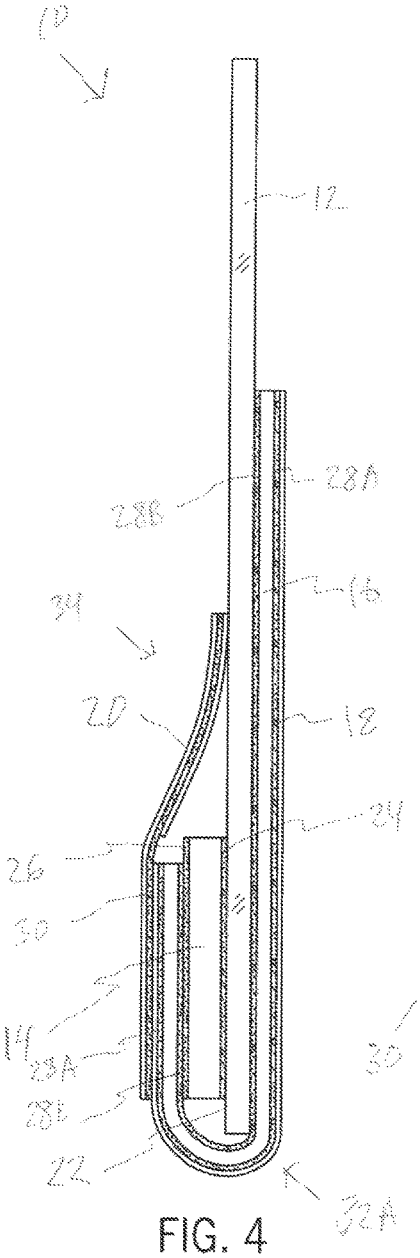
FIG. 4 is a crossectional view of the device taken down the middle, longitudinally, of the device.

A preferred embodiment of the note taking device 10 of the invention is shown in FIG. 1 in a normal, un-deployed state. Referring also to FIG. 4, the device 10 primarily comprises a base member 12, a ledge member 14, and a connection member, portion or layer 16. First and second release liners 18 and 20 are coupled to the connection member 16.

The base member 12 is disposed generally centrally in the device 10. The base 12 has a rectilinear geometry, and preferably rectangular. The base 12 is constructed of a light weight rigid material preferably plastic. Most preferably, the base 12 is clear/transparent, or at least translucent. The ledge 14 is disposed (in the un-deployed state) on a front side of the base 12, close to, but not directly at the bottom end of the base 12. A space or gap 22 separates the ledge 14 from the bottom of the base 12. The preferred dimension of the gap is approximately the thickness of the ledge 14, or in the embodiment shown, two (2.0) mm. The ledge 14 also has a rectilinear, rectangular configuration. It is constructed of a semi-rigid polymeric foam material. The ledge 14 has a first adhesive layer 24 on one side and a second adhesive layer 26 on the opposite, outward side of the device 10. The first adhesive layer 24 lightly adheres the ledge 14 to the base in a flat orientation, best shown in FIG. 4. This permits the ledge 14 to separate, under hand operation by a user, and pivotally move from the base 12 during deployment to a horizontal position as described and shown further below. The second adhesive layer 26 cooperates with and holds to an adhesive on the connection layer 16. The connection member 16 is disposed on a back side of the base 12 beginning a predetermined distance away (approximately one quarter the length of the base 12 or in the preferred embodiment shown 15.0 mm.) from the top end of the base 12. The connection member 16 wraps around and forms a predetermined bend 32A (un-deployed state "bend") at the bottom end of the device 10 and extends upwardly on the front side of the device 10 terminating substantially aligned with the top end of the ledge 14. The connector 16 also preferably has a rectangular configuration. The connector 16 is preferably constructed of flexible foam with an adhesive layer 28A/B on each side or face. The outward layer of adhesive 28A is covered by the first release liner 18. When removed, the adhesive 28A adheres the connector 16 to an external surface such as a wall, office furniture, vehicle interior, notebook, or the like. The inward layer of adhesive 28B adheres the connector 16 to the back of the base 12. Adhesive 28B also cooperates with the adhesive 26 of the ledge 14 to form a strong bond. First release liner 18 is a thin, flexible, polymeric layer that convers the connector 16 during storage and transportation. It is easily removed by hand operation prior to use and connection of the device 10 to an external surface. Second release liner 20 is similarly constructed of a thin, flexible polymeric material. It further has an adhesive 30 on an inward face for releasable coupling with the first release layer 18. It is further useable as an aid in pulling down and pivotally deploying the ledge 14. The second liner 20 preferably extends beyond the ends of the ledge 14 and connector 16 a predetermined distance to provide a convenient tab 34 to be more easily grasped by a user. In an alternative embodiment, the two part release layer may be constructed as a single, continuous structure. The lateral edges of the base 12, ledge 14, connector 16, and first and second release liners 18 and 20 are all preferably co-extensive and aligned.

Figure 2:
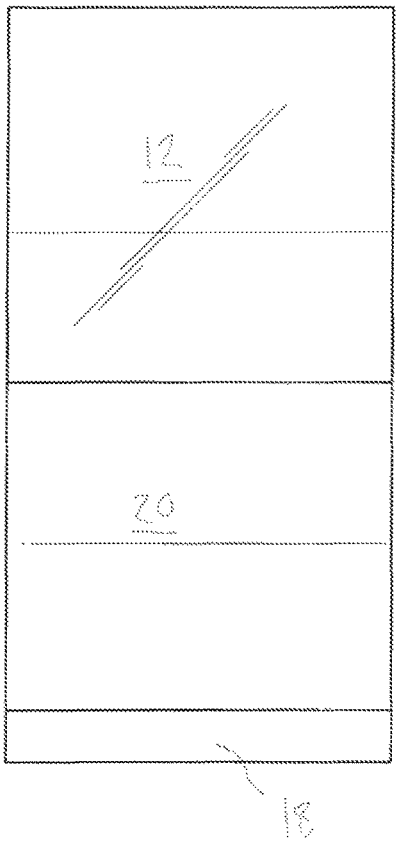
FIG. 2 is a front, elevation view of the device.
Figure 3:
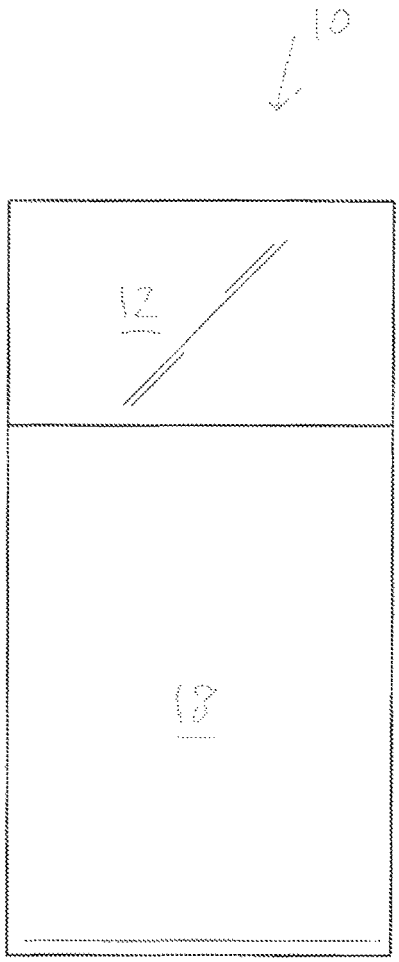
FIG. 3 is a back view of the device.
Figure 5:
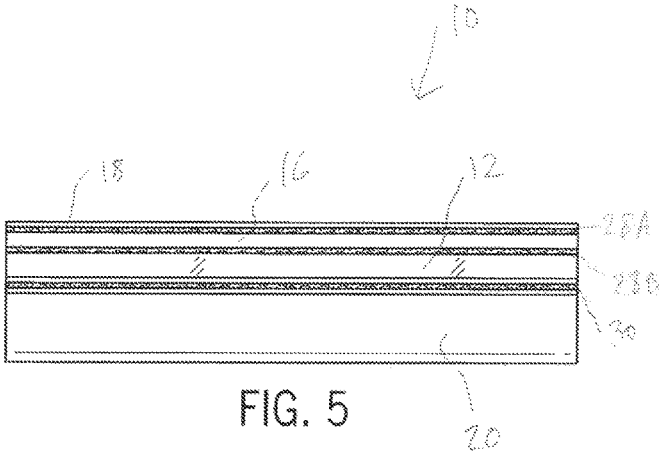
FIG. 5 is a top view of the device.
Figure 6:
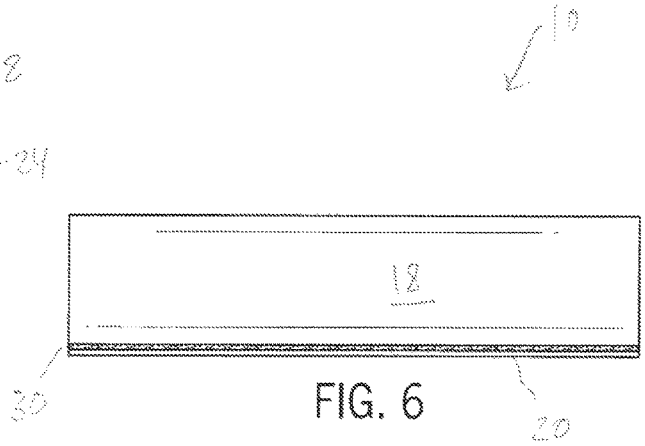
FIG. 6 is a bottom view of the device.
Figure 9:
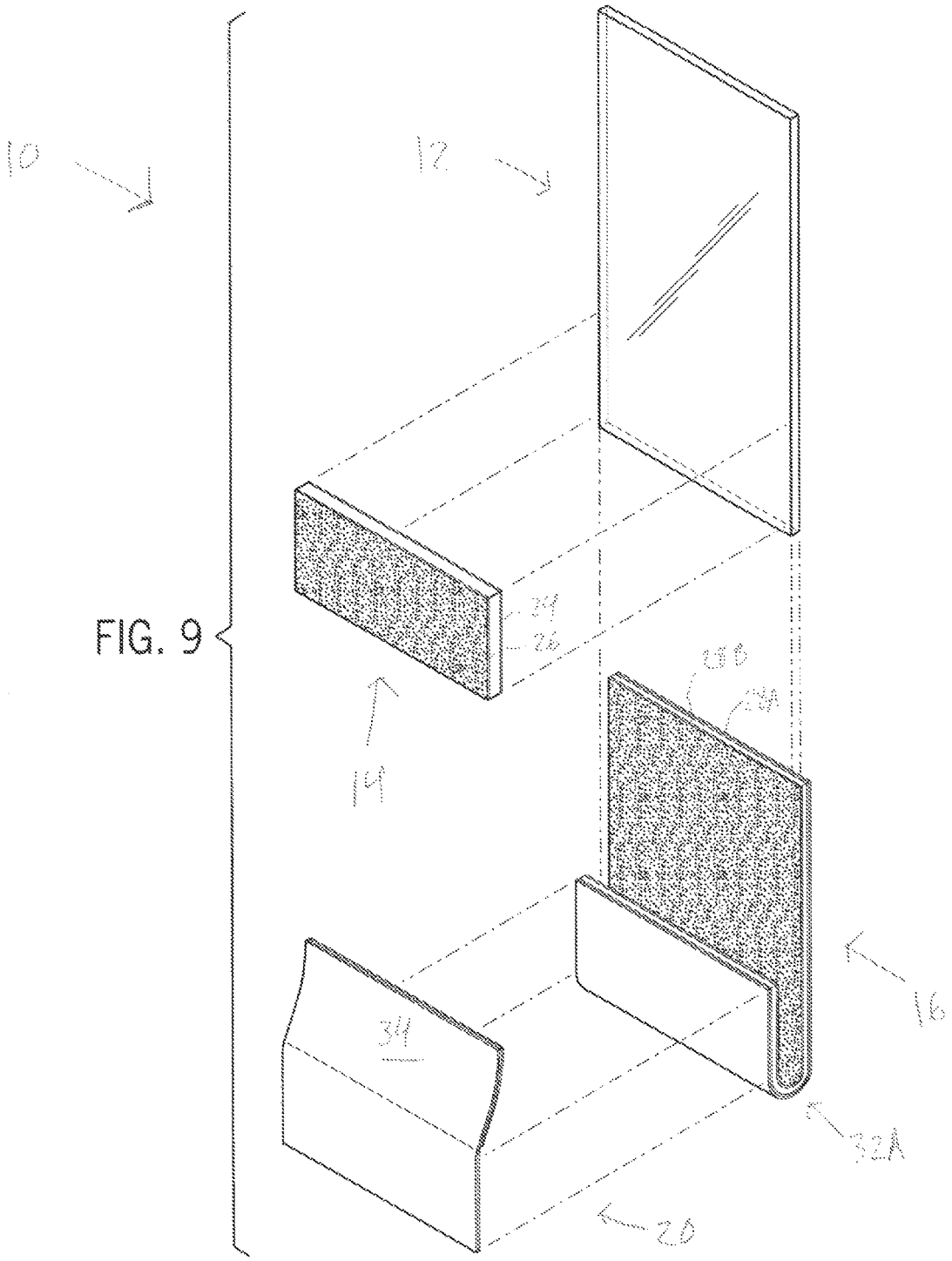
FIG. 9 is an exploded view of the device.

FIG. 2 is a front, elevation view of the device 10 in the un-deployed state. FIG. 3 is a back view of the device 10. FIGS. 5 and 6 are top and bottom views, respectively, of the device 10. And FIG. 9 is an exploded view of the device 10.

Figure 7:
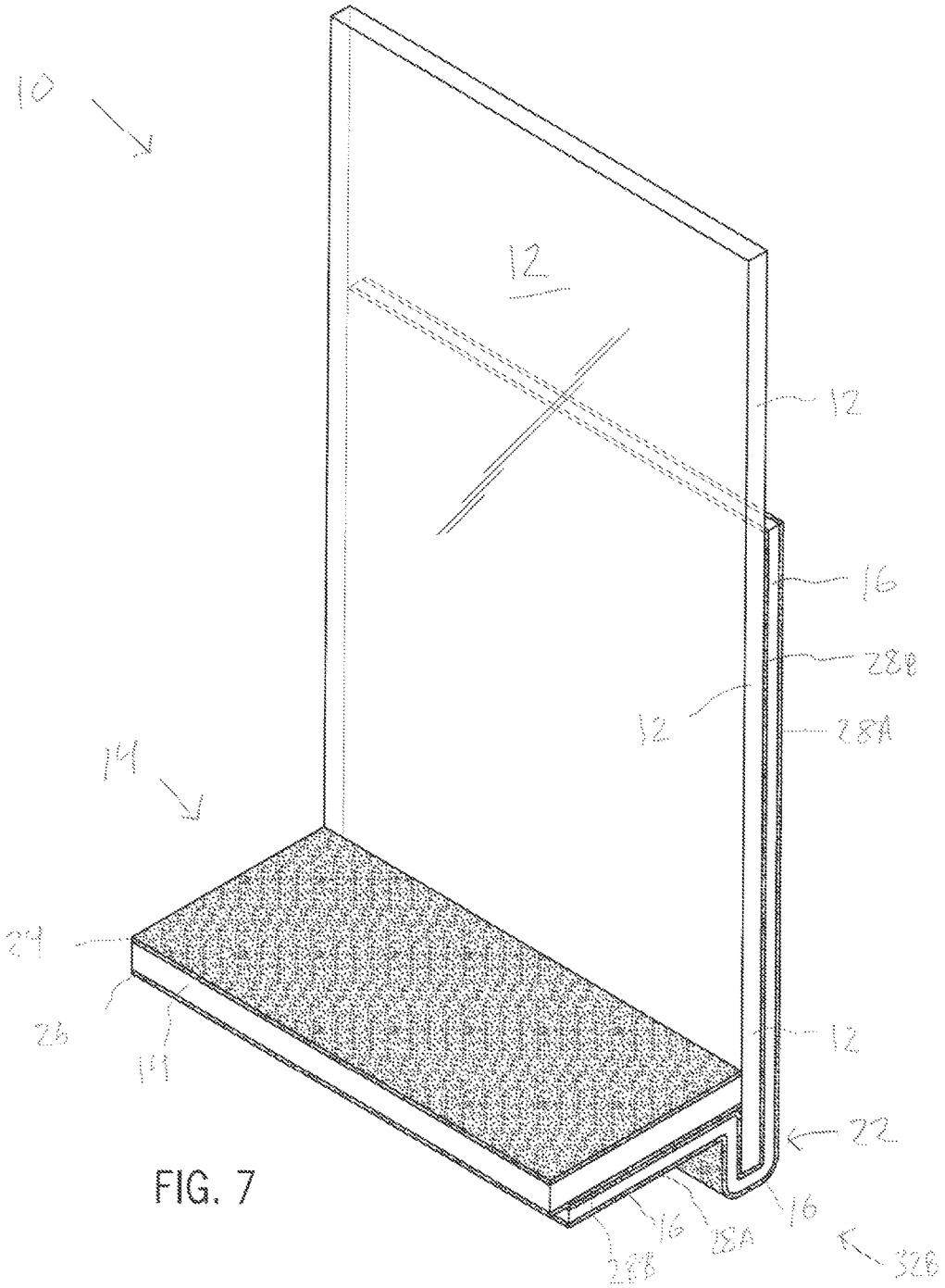
FIG. 7 is a perspective view of the device in a deployed state attached or ready for attachment to an exterior surface.
Figure 8:
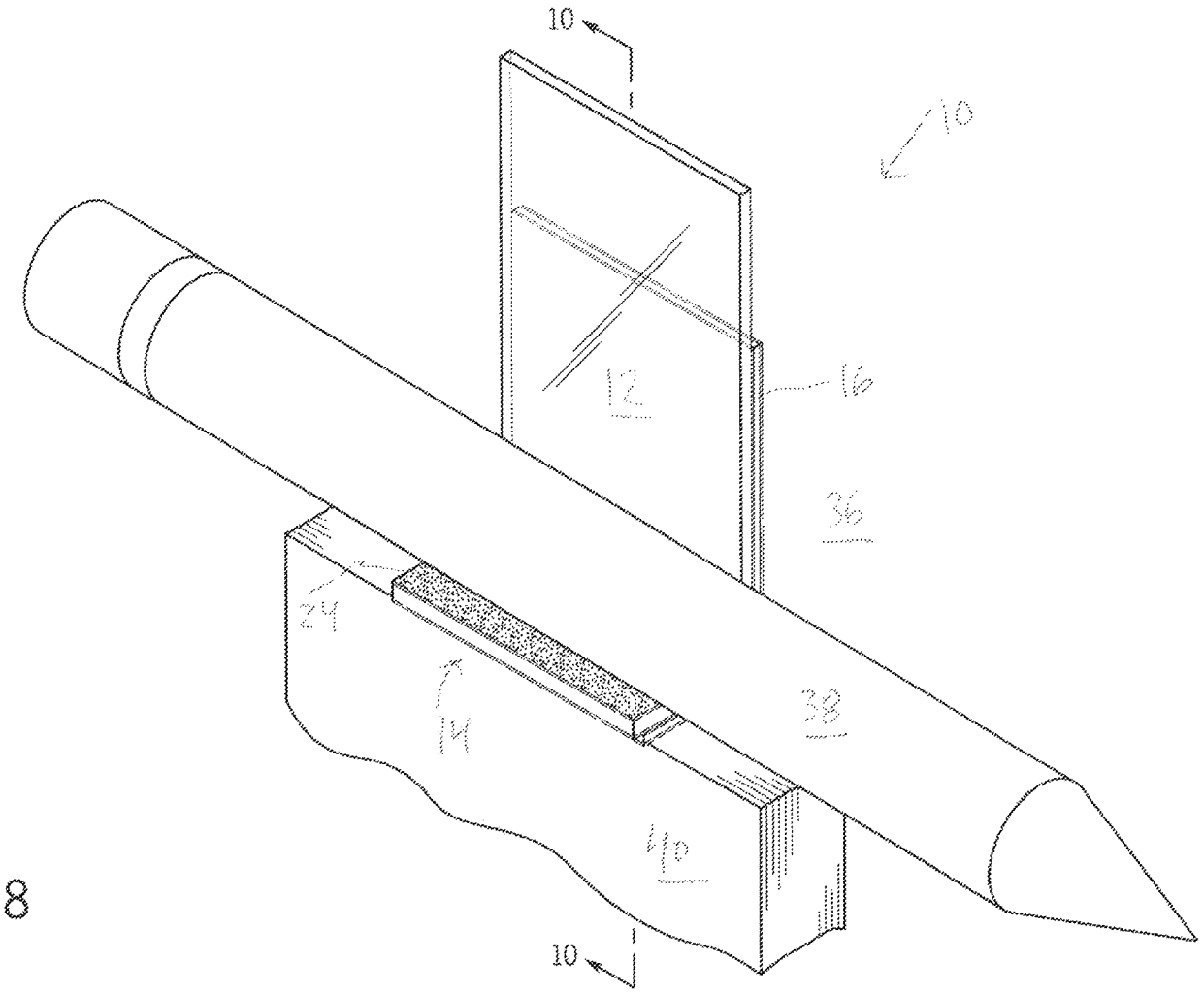
FIG. 8 is a perspective view of the deployed device arranged vertically and operatively holding a writing instrument and a note pad.
Figure 10:
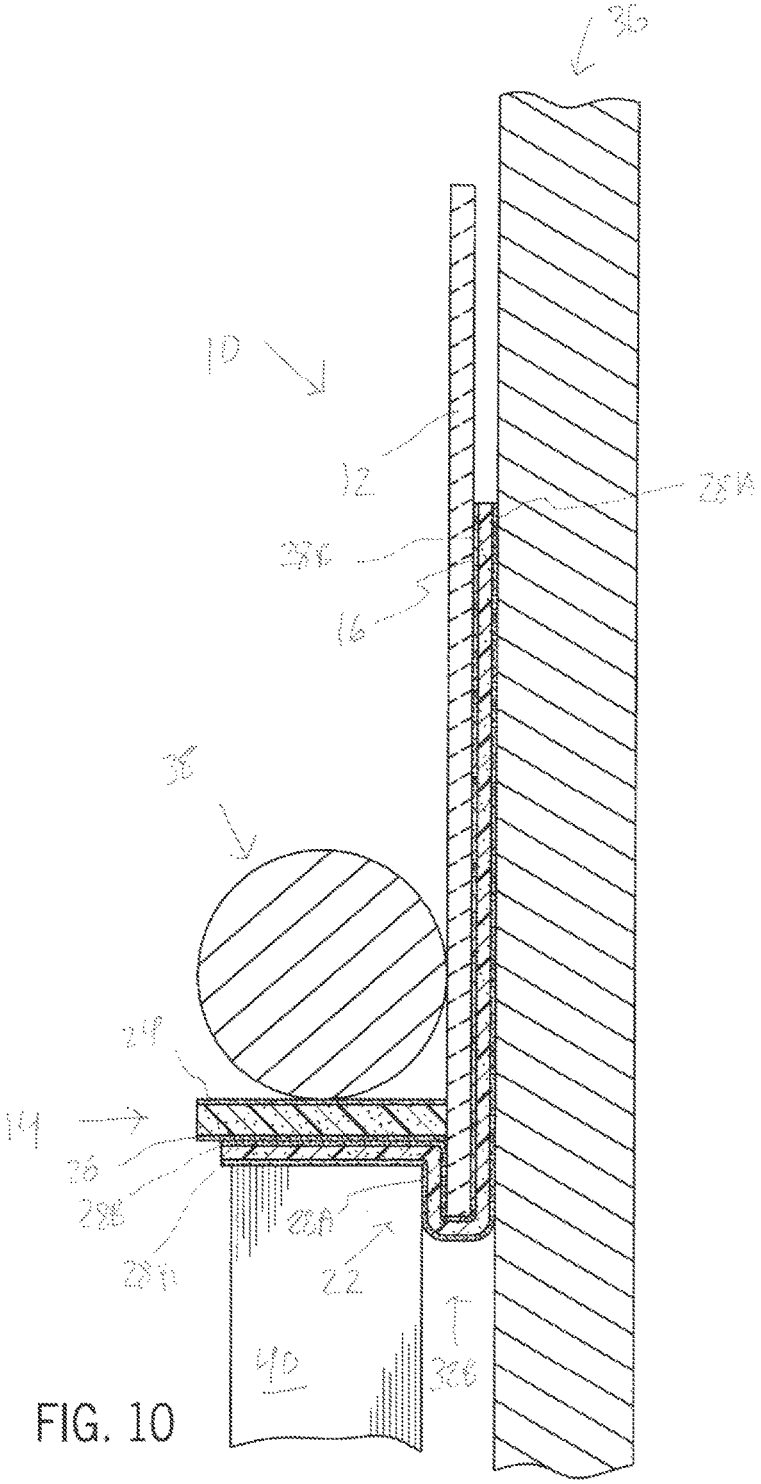

In the preferred embodiment shown, the un-deployed device 10 optimally has a length (longitudinally) of 50 mm. and a width of 25 mm. At its thickest point near the bottom, the device 10 has a thickness of 6.5 mm. The base member 12 has dimensions approximately 50×25 mm. and a thickness of 1.5 mm. The ledge member 14 has dimensions 12×25 mm and a thickness of 2.5 mm. Connection layer 16 has optimal thickness of 2.0 mm, and a back dimension of 35×25 mm (the same dimensions as the first release layer 18) and a front dimension of 15×25 mm. Secondary release member 20 has a preferred dimension of 25×25 mm. This provides an optimal device 10 for holding a standard size pen, pencil or marker (15 cm. long-1.0 cm. diameter), along with a small common 5 cm wide by 4 cm tall by 0.5 cm thick pad, or a large common 7.5 cm wide by 7.7 cm tall by 0.5 cm thick pad of releasable adhesive office notes FIG. 7 shows the device 10 in a deployed state attached or ready for attachment to an exterior surface 36. FIGS. 8 and 10 are perspective views of the deployed device 10 arranged vertically and operatively holding a writing instrument 38 such as a pen, pencil or marker, and a note pad 40. In the deployed state, the first release liner 18 is removed by light manual pulling or lifting exposing the adhesive layer 28A of the connector 16. The connector 16 is then placed by the user in a desirable position, for example on a vertical wall 36 and lightly pressed establishing a secure adhesive connection thereto. Next, the second release liner 20 is grasped by the user and the vertically oriented ledge 14 is pivotally pulled down to a horizontal position modifying bend 32A to form the configuration of 32B. In this orientation, the ledge 14 (and particularly the flat plane of the ledge 14) is disposed substantially perpendicular to the base 12 (and particularly the flat plane of the base 12) and is usable to support a pen or pencil 38 in a convenient place for use. The optional light adhesive 24 facilitates holding of the writing utensil 38. Additionally, a note pad 40 such as a Post-It Pad® (available from 3M of St Paul, Minn., USA) may be attached to the bottom of the ledge, with the spine at the top of the pad 40 being secured by the adhesive layer 28A at both the top and a portion of the side along segment 22.

This system and method provides an easy to deploy, secure, and sustainable connection and platform to place both a writing implement and a pad of note papers in any place the user finds most convenient.

In another embodiment, adhesive segments of commonly used "sticky note" for self adherence of sticky segments of two individual notes to approximate each other forming a union which multiplies holding strength with the purpose of securing a note or a pad of notes to a desired surface.

An initial or primary or base holding item is applied to a desired surface or area of work or other use surface with the subsequent application of the non-adhesive segment of a single or pad at the upward area of the desired application area. After the pad is utilized a page of the sticky notes is retained and it then serves as a base for application of another pad with its sticky area approximating the retained page sticky area which then allows use of an additional pad without use of additional base.

Yet another embodiment of the invention provides a caddy or valet for confining or holding utility items in a stationary position as desired consisting of a large base segment of Airstick™—like microsuction non-residue, surface mount tape (or a select from numerous other releasable retention tapes) having its retentive surface down secured on a firm surface and its non-retention surface facing up with a smaller segment of the same type or of other retention tape positioned on the top surface of the base with the smaller segment having its retentive surface facing up thus enabling on and off and on again securing of useful item without removing the small retentive segment or lifting the large base securing segment due to geometric differences in adhesive properties.

In such a configuration, the upper confined or defined area with its (smaller than base segment) microsuction or adhesive serves as home base for various utility or useful items such as coffee cups, children's food plates, airplane seatback or arm rest trays for food and beverage, passenger utility items, ships food serving and eating tables, cell phone depos, chair backs and stools, etc. all of which are prevented from spilling or sliding. The caddy and/or valets are invaluable for helping infants retain on tray or table food and play items. In addition the base with its caddy can be wrapped around or on chair legs or backs to aid in securing certain plastic or fiber items and/or to hold items such as "Chair Booties" or special toys, wheelchair trays and backs, items utilized as aids for walking and stability and wrist or body cloths for holding eye glasses bicycles, tricycles, hospital beds, patient charts, handicapped individual's clothing access items. Personal clothing for knives, forks etc. After removal of the item secured, the retained base caddy and/or the securing segment may be cleaned with a damp cloth for repeat uses. In like manner as above, Velcro™ may be utilized in conjunction with the application of an Airstick™ material serving as the base adherent which is larger than a segment of hook and/or loop adhered to the top surface of it. The small adhered segment may consist of the hook material or the loop segment and in either case the opposite indicated loop or hook is applied to the utility item to be stationed. This variation requires the item to be retained or immobilized to have applied to its surface a marriageable segment of the loop or hook; which ever applies.

Although the device is described in terms of vertical, horizontal, transverse (lateral), longitudinal, and the like. It should be understood that variations from the absolute vertical, horizontal, transverse, and longitudinal are also within the scope of the present invention.

Although the apparatus/method has been described in connection with the field of organizational, office supply and home supplies, it can readily be appreciated that it is not limited solely to such field, and can be used in other fields.

The embodiments above are chosen, described and illustrated so that persons skilled in the art will be able to understand the invention and the manner and process of making and using it. The descriptions and the accompanying drawings should be interpreted in the illustrative and not the exhaustive or limited sense. The invention is not intended to be limited to the exact forms disclosed. While the application attempts to disclose all of the embodiments of the invention that are reasonably foreseeable, there may be unforeseeable insubstantial modifications that remain as equivalents. It should be understood by persons skilled in the art that there may be other embodiments than those disclosed which fall within the scope of the invention as defined by the claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A holder for holding at least two utensils to an external surface, comprising;

a base having front and back faces, and a top, bottom and two side edges;

a connector coupled to the back face of the base and adapted to be connected to the external surface; wherein the connector has a substantially flat configuration with an inward surface adhesively connected to the base, and an outward surface adapted to be adhesively connected to the external surface, and wherein the connector extends around the bottom edge of the base and a predetermined distance along the front face of the base; and a ledge having top and bottom faces and top, bottom and two side edges, the ledge back face being adhered to the front face of the base; the ledge being pivotal with respect to the base so that the top and bottom faces are substantially perpendicular to the base, and wherein the top, bottom or both ledge faces are adapted to connect to a utensil.

2. The holder of claim 1 wherein the at least two utensils adapted to be held by the holder are selected from the group of utensils consisting of a pen, pencil, marker, paper, pad of paper, and pad of releasable adhesive note papers.

3. The holder of claim 1, wherein the holder is adapted to be connected to an external vertical wall of a building, appliance, device or article.

4. The holder of claim 1, wherein the base is rigid and has a substantially flat configuration.

5. The holder of claim 1, wherein the connector is a double sided adhesive, polymeric foam member.

6. The holder of claim 1, further comprising a release liner releasably coupled to the outward surface of the connector.

7. The holder of claim 1, wherein the ledge has a substantially flat configuration with an inward surface releasably adhesively connected to the base and an opposite outward surface, and wherein in a pivoted state the inward surface is oriented upwardly and the outward surface is oriented downwardly.

8. The holder of claim 7, wherein the ledge is a polymeric foam member.

9. The holder of claim 7, wherein the ledge inward surface has an adhesive coating which permits release from the base.

10. The holder of claim 7, wherein the ledge outward surface has an adhesive coating for securely holding a pad of paper, or a pad of releasable adhesive note papers.

11. The holder of claim 7, wherein the ledge, when flat and adhesively connected to the base, is disposed a predetermined distance from the bottom edge of the base so that when pivoted, an inward edge of the ledge is adhesively coupled to the base.

12. The holder of claim 1, wherein:

the base is rigid and has a substantially flat configuration;

the ledge, when flat and adhesively connected to the base, is disposed a predetermined distance from the bottom edge of the base so that when pivoted, an inward edge of the ledge is adhesively coupled to the base; and the ledge has a substantially flat configuration with an inward surface releasably adhesively connected to the base and an opposite outward surface, and wherein in a pivoted state the inward surface is oriented upwardly and the outward surface is oriented downwardly.

13. The holder of claim 12, wherein the ledge, when flat and adhesively connected to the base, is disposed a predetermined distance from the bottom edge of the base so that when pivoted, an inward edge of the ledge is adhesively coupled to the base.

14. The holder of claim 13, wherein, in the pivoted state:

the upwardly oriented surface of the ledge is adapted to hold a writing instrument; and the downwardly oriented surface of the ledge is adapted to hold a pad of paper.

15. A holder for holding a writing instrument and a pad of paper to an external wall surface, comprising:

a. a base having front and back faces, and a top, bottom and two side edges, the base is rigid and has a substantially flat configuration;

b. a connector coupled to the back face of the base and adapted to be connected to the external surface, the connector having a substantially flat configuration with an inward surface adhesively connected to the base, and an outward surface adapted to be adhesively connected to the external surface; and c. a ledge having top and bottom faces and top, bottom and two side edges, the ledge hack face being adhered to the front face of the base; the ledge being pivotal with respect to the base so that the top and bottom faces are substantially perpendicular to the base, and wherein the top ledge face is adapted to hold a writing instrument and the bottom ledge face us adapted to adhesively hold a pad of paper, the ledge having a substantially flat configuration with an inward surface releasably adhesively connected to the base and an opposite outward surface, and wherein in a pivoted state the inward surface is oriented upwardly and the outward surface is oriented downwardly.

16. A method of holding at least two utensils to an external surface, comprising the steps of:

a. providing a holder including:

i. a base having front and back faces, and a top, bottom and two side edges;

ii. a connector coupled to the back face of the base and adapted to be connected to the external surface; and iii. a ledge having top and bottom faces and top, bottom and two side edges, the ledge back face being adhered to the front face of the base; the ledge being pivotal with respect to the base so that the top and bottom faces are substantially perpendicular to the base, and where the top, bottom or both ledge faces are adapted to connect to a utensil;

b. pivoting the ledge with respect to the base;

c. placing one utensil on an upwardly facing ledge face; and d. adhesively coupling a second utensil to the downwardly facing ledge face.

17. The method of holding of claim 13, wherein in the holder:

the base is rigid and has a substantially flat configuration;

the connector has a substantially flat configuration with an inward surface adhesively connected to the base, and an outward surface adapted to be adhesively connected to the external surface;

the ledge, when flat and adhesively connected to the base, is disposed a predetermined distance from the bottom edge of the base so that when pivoted, an inward edge of the ledge is adhesively coupled to the base and extends around the bottom edge of the base and a predetermined distance along the front face of the base; and the ledge has a substantially flat configuration with an inward surface releasably adhesively connected to the base and an opposite outward surface, and wherein in a pivoted state the inward surface is oriented upwardly and the outward surface is oriented downwardly.

18. The method of claim 17, wherein one utensil is a writing instrument placed on the upwardly facing ledge face and one utensil is a pad of paper adhesively coupled to the downwardly facing ledge face.

19. A holder for holding at least two utensils to an external surface, comprising;

a base having front and back faces, and a top, bottom and two side edges, wherein the base is rigid and has a substantially flat configuration;

a connector coupled to the back face of the base and adapted to be connected to the external surface; wherein the connector has a substantially flat configuration with an inward surface adhesively connected to the base, and an outward surface adapted to be adhesively connected to the external surface, and wherein the connector extends around the bottom edge of the base and a predetermined distance along the front face of the base; and a ledge having top and bottom faces and top, bottom and two side edges, the ledge back face being adhered to the front face of the base; the ledge being pivotal with respect to the base so that the top and bottom faces are substantially perpendicular to the base, wherein the top, bottom or both ledge faces are adapted to connect to a utensil, and wherein the ledge, when flat and adhesively connected to the base, is disposed a predetermined distance from the bottom edge of the base so that when pivoted, an inward edge of the ledge is adhesively coupled to the base and extends around the bottom edge of the base and a predetermined distance along the front face of the base, and wherein the ledge has a substantially flat configuration with an inward surface releasably adhesively connected to the base and an opposite outward surface, and wherein in a pivoted state the inward surface is oriented upwardly and the outward surface is oriented downwardly.

* * * * *